US006793042B2

(12) United States Patent
Brouillet

(10) Patent No.: US 6,793,042 B2
(45) Date of Patent: Sep. 21, 2004

(54) DUAL INDEPENDENT TANK AND OIL SYSTEM WITH SINGLE PORT FILLING

(75) Inventor: Sylvain Brouillet, Saint-Basile-le-Grand (CA)

(73) Assignee: Pratt & Whitney Canada Corp., Longueuil (CA)

( * ) Notice: Subject to any disclaimer, the term of this patent is extended or adjusted under 35 U.S.C. 154(b) by 223 days.

(21) Appl. No.: 10/200,755

(22) Filed: Jul. 24, 2002

(65) Prior Publication Data

US 2004/0016601 A1 Jan. 29, 2004

(51) Int. Cl.[7] ..... F01M 11/12
(52) U.S. Cl. ..... 184/6.11; 184/103.1
(58) Field of Search ..... 184/1.5, 103.1, 184/103.2, 6.11; 60/39.08

(56) References Cited

U.S. PATENT DOCUMENTS

| | | | | |
|---|---|---|---|---|
| 3,960,174 A | | 6/1976 | Latimer et al. | 137/563 |
| 4,002,224 A | * | 1/1977 | Easter | 184/6.11 |
| 4,105,093 A | * | 8/1978 | Dickinson | 184/6.11 |
| 4,157,744 A | | 6/1979 | Capriotti | |
| 4,346,786 A | | 8/1982 | Midgley | |
| 4,511,016 A | | 4/1985 | Döëll | |
| 4,531,358 A | | 7/1985 | Smith | |
| 4,779,413 A | * | 10/1988 | Mouton | 60/39.08 |
| 4,856,273 A | | 8/1989 | Murray | |
| 4,947,963 A | | 8/1990 | Aho, Jr. | |
| 5,400,889 A | * | 3/1995 | Bell et al. | 192/113.3 |
| 5,565,094 A | * | 10/1996 | Zoch et al. | 210/86 |
| 5,611,411 A | * | 3/1997 | Reilly, III | 184/6.4 |
| 2003/0079710 A1 | * | 5/2003 | Webster et al. | 123/196 R |

FOREIGN PATENT DOCUMENTS

| | | |
|---|---|---|
| DE | 199 25 779 | 12/2000 |
| EP | 1167706 | 1/2002 |

* cited by examiner

*Primary Examiner*—Chong H. Kim
(74) *Attorney, Agent, or Firm*—Ogilvy Renault; Robert Mitchell

(57) ABSTRACT

A lubrication system for lubricating gas turbine engine components and accessory components separately comprises first and second lubricant circulating circuits for separately feeding lubricant to the engine components and the accessory components. The system further includes a supply tank with first and second separate chambers respectively connected in fluid flow communication with the first and second lubricant circulating circuits. A filler port is defined in the tank for allowing the first chamber to be filled with lubricant. A filling and level maintaining circuit is connected to the first lubricant circulating circuit for directing a portion of the lubricant fluid pumped from the first chamber into the second chamber, thereby obviating the need for a second filler port.

20 Claims, 2 Drawing Sheets

DUAL INDEPENDENT TANK AND OIL SYSTEM WITH SINGLE PORT FILLING

BACKGROUND OF THE INVENTION

1. Field of the Invention

The present invention relates to lubrication and, more particularly, to a lubrication system suited for independently lubricating the engine components and the accessory components of a gas turbine engine.

2. Description of the Prior Art

It is known to independently feed lubricant to the accessory components and the engine components of a gas turbine engine. This is typically achieved by providing two separate oil tanks, one for accessory lubrication and one for engine lubrication. Each tank is connected to a distinct lubricant re-circulating circuit for respectively feeding oil to the engine components and the accessory components. Each tank must have its own filler port and its own oil level indicator. This tank duplication represents additional work for the technician, which must fill two tanks and thereafter monitor two different levels of oil. The use of two tanks also contributes to increase the overall weight of the gas turbine engine lubricating system and requires additional space, which is not suitable due to size constraints on a gas turbine engine.

SUMMARY OF THE INVENTION

It is therefore an aim of the present invention to provide a new supply tank, which facilitates maintenance of a dual independent lubrication system.

It is a further aim of the present invention to minimize the weight and part numbers of a lubrication system having two independent lubricant circulating circuits.

It is a further aim of the present invention to provide a gas turbine engine lubrication system comprising a tank having two chambers for lubricating engine and accessory components separately.

Therefore, in accordance with the present invention, there is provided a lubrication system for lubricating gas turbine engine components and accessory components separately, comprising first and second lubricant circulating circuits for separately feeding lubricant to the engine components and the accessory components, a supply tank with first and second separate chambers respectively connected in fluid flow communication with said first and second lubricant circulating circuits, a filler port for allowing said first chamber to be filled with lubricant, and a filling and level maintaining circuit connected to said first lubricant circulating circuit for directing a portion of the lubricant fluid pumped from said first chamber into said second chamber, thereby allowing said second chamber to be initially filled and the level of lubricant contained therein subsequently maintained at a predetermined level.

In accordance with a further general aspect of the present invention, there is provided a lubrication system for separately supplying lubricant to first and second set of components, comprising first and second lubricant circulating circuits for separately feeding lubricant to the first and second sets of components, said first and second lubricant circulating circuit being fed by a common supply tank having first and second separate chambers respectively connected in fluid flow communication with said first and second lubricant circulating circuits, a filler port defined in said supply tank for allowing said first chamber to be filled with lubricant, a pump for withdrawing lubricant from said first chamber, wherein a first portion of the lubricant pumped from said first chamber is directed to the first set of components via said first lubricant circulating circuit before being returned back to said first chamber, whereas a second portion of the lubricant fluid pumped from the first chamber is directed into said second chamber through a filling and level maintaining circuit connected to receive a flow of lubricant from said first chamber to initially permit filling of said second chamber and to subsequently maintain a predetermined volume of lubricant in said second chamber.

In accordance with a further general aspect of the present invention, there is provided a dual supply tank for independently supplying lubricant to a gas turbine engine lubricating circuit and an accessory lubricating circuit. The tank comprises first and second separate chambers adapted to separately feed the gas turbine engine lubricating circuit and the accessory lubricating circuit, a single filler port for filling said first chamber, a nozzle for directing a flow of lubricant from said first chamber to a scupper, said scupper being connected in flow communication with said second chamber for allowing filling of said second chamber up to a predetermined level and thereafter redirect the excess lubricant flowing out of the nozzle away from said second chamber.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
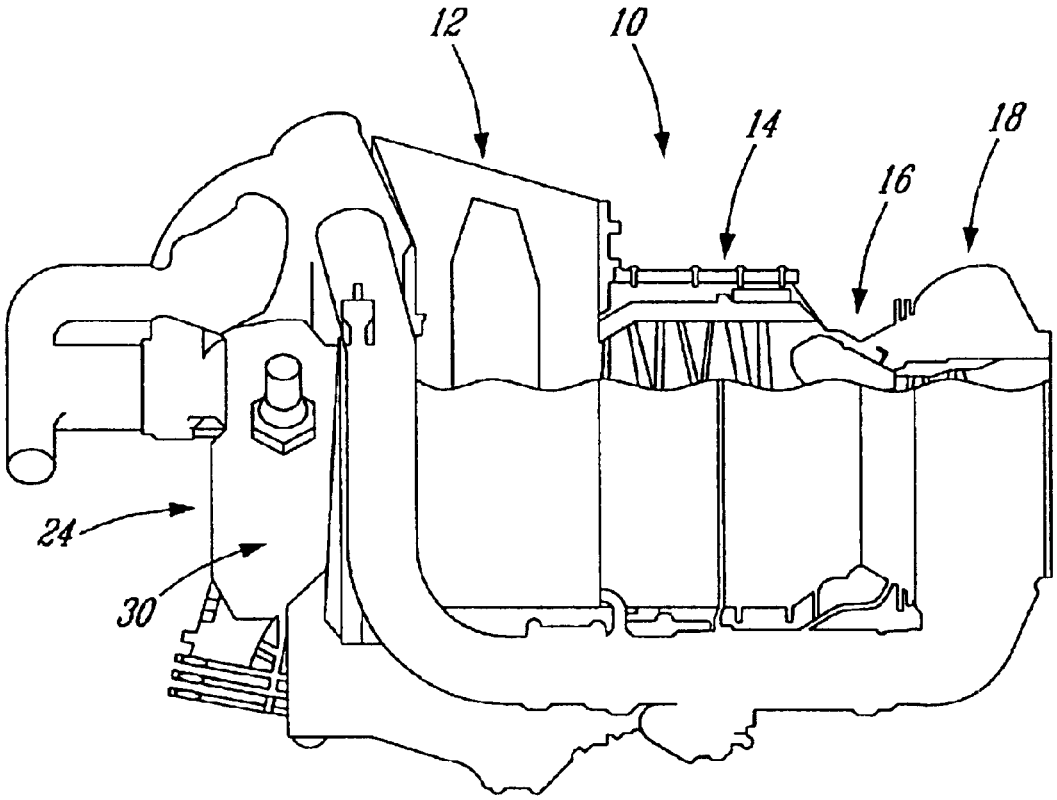
FIG. 1 is a side view, partly in cross-section, of a gas turbine engine incorporating a lubrication system in accordance with a preferred embodiment of the present invention.

FIG. 1 illustrates a gas turbine engine 10 generally comprising in serial flow communication a fan 12 through which ambient air is propelled, a multistage compressor 14 for pressurizing the air, a combustor 16 in which the compressed air is mixed with fuel and ignited for generating hot combustion gases, and a turbine 18 for extracting energy from the combustion gases.

Figure 2:
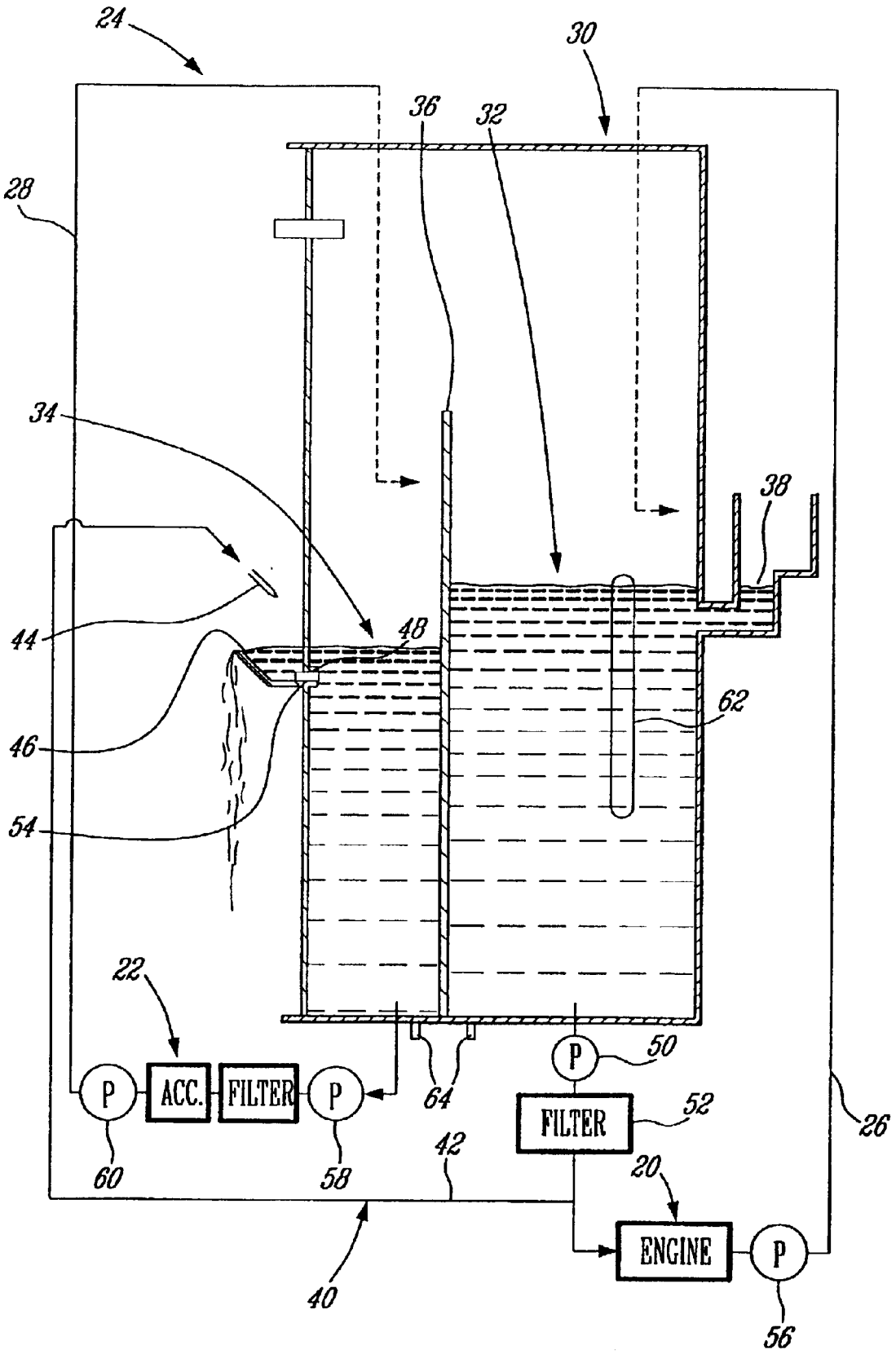
FIG. 2 is a diagrammatic representation of the lubrication system partly shown in FIG. 1.

As schematically illustrated in FIG. 2, the engine 10 also includes various engine components 20, such as bearings and gearboxes, which must be suitably lubricated. The engine 10 also typically includes various accessories, such as pumps and generators, which are engine driven through gear trains. Among these accessories, there are also a number of accessory components 22, which must be suitably lubricated.

According to the present invention, the engine components 20 and the accessory components 22 are individually supply with lubricant. This is accomplished through the use of a lubrication system 24 comprising first and second separate lubricant circulating circuits 26 and 28. In this way, the engine components 20 have their own lubrication circuit and the accessory components 22 have another lubrication circuit. The circuits 26 and 28 are connected to a single supply tank 30 having first and second separate chambers 32 and 34. The first lubricant circuit 26 is connected in fluid flow communication with the first chamber 32, whereas the second lubricant circulating circuit 28 is connected in fluid flow communication with the second chamber 34. In other words, the supply tank 30 has two separate chambers, one for supplying lubricant to the engine components 20 and one for supplying lubricant to the accessory components 22.

A partition wall 36 is provided within the tank 30 to prevent lubricant contained in the first chamber 32 from flowing into the second chamber 34 and vice versa. Although the first and second chambers 32 and 34 are segregated from one another, the supply tank 30 comprises a single filler port 38 through which a lubricant, such as virgin oil, can be fed to fill the first chamber 32. The second chamber 34 is filled via a filling and level maintaining circuit 40 connected in fluid flow communication with the first lubricant circulating circuit 26. Accordingly, the operator does not have to unscrew the cap of a second filler port for initially filling the second chamber 34. The second chamber 34 is filled from the first chamber 32, preferably through a filter 52 to insure complete segregation of the engine and the accessories oil systems. This contributes to reduce the chances for human error in filling the tank 30.

The filling and level maintaining circuit 40 includes a feed line 42 having a downstream end connected to the first lubricant circulating circuit 26 and an upstream end connected to a nozzle 44 for discharging filtered lubricant into a scupper 46. The scupper 46 forms a receptacle having a hole or an orifice 48 defined in the bottom thereof for allowing lubricant to pass from the scupper 46 into the second chamber 34.

A pump 50 is provided in the first lubricant circulating circuit 26 for withdrawing lubricant from the first chamber 32. Filling of the second chamber 34 is effected by operating the pump 50. Indeed, a portion of the lubricant pumped from the first chamber 32 will flow through the filter 52 and the feed line 42 before being discharged into the scupper 46 by the nozzle 44. The lubricant will then flow from the scupper 46 into the second chamber 34 until the level of lubricant in the second chamber 34 reaches the level of lubricant in the scupper 46. That is to say that the level of lubricant in the second chamber 34 is set by the scupper 46. Once the second chamber 34 has been filled, the continuous flow of lubricant discharged from the nozzle 44 spills over the scupper 46 to the engine before being pumped back into the first chamber 32. The lubricant fed to the second chamber 34 is pumped through the filter 52, whereby it is always free from contaminant that might be present in the engine components.

As shown in FIG. 2, a one-way valve 54 or the like may be placed in the orifice 48 to prevent lubricant to pass from the second chamber 34 into the scupper 46. This prevents contamination of the lubricant circulated in the first circuit 26 by the lubricant circulated in the second circuit 28.

A second portion of the lubricant pumped from the first chamber 32 is directed to the engine components 20, through the filter 52, and pumped back into the first chamber 32 by scavenge pumps 56. Various equipments, such as coolers, aerators and filters may be provided in the return lines of the first circuit 26, as is well known in the art.

Likewise, the second circuit 28 comprises a pump 58 for pumping lubricant from the second chamber 34 to the accessories components 22. Scavenge pumps 60 are provided downstream of the accessory components 22 for pumping the lubricant back into the second chamber 34. As for the first circuit, various equipments may be provided in the second circuit 28 to treat the lubricant before it is returned into the second chamber 34.

The supply tank 30 is provided with a single level indicator 62 for monitoring the level of lubricant in the first chamber 32. The level indicator 62 can be provided in the form of a sight-glass. The level of lubricant in the second chamber 34 does not have to be monitored since it is maintained substantially constant by the continuous flow of lubricant from the first chamber 32 to the scupper 46. Indeed, as soon as the level of lubricant in the second chamber 34 starts to fall due to lubricant consumption of the accessory lubricant circuit 28, a corresponding amount of lubricant flows from the scupper 46 into the second chamber 34 through the orifice 48, thereby ensuring a constant level of lubricant in the second chamber 34.

The only direct connection between the first and second chambers 32 and 34, for venting purposes, is above the maximum lubricant level and the return lines. Therefore, no contaminant can transfer between the two chambers 32 and 34.

As shown in FIG. 2, a drain 64 is provided in the base of each chamber 32 and 34.

The use of a dual independent tank 30 with a single filling port and a single level indicator is advantageous in that it provides space saving, while at the same time facilitating the maintenance of the lubrication system 24. It also contributes to minimize the number of piece composing the lubrication system and, thus, advantageously minimize the cost and the weight of the overall system.

What is claimed is:

1. A lubrication system for lubricating gas turbine engine components and accessory components separately, comprising first and second lubricant circulating circuits for separately feeding lubricant to the engine components and the accessory components, a supply tank with first and second separate chambers respectively connected in fluid flow communication with said first and second lubricant circulating circuits, a filler port for allowing said first chamber to be filled with lubricant, and a filling and level maintaining circuit connected to said first lubricant circulating circuit for directing a portion of the lubricant fluid pumped from said first chamber into said second chamber, thereby allowing said second chamber to be initially filled and the level of lubricant contained therein subsequently maintained at a predetermined level.

2. A lubrication system as defined in claim 1, further including a pump for pumping lubricant from said first chamber to the engine components and to said second chamber, and wherein the filling and level maintaining circuit discharges the lubricant pumped from the first chamber into a scupper connected in fluid flow communication with the second chamber, the level of lubricant in the second chamber being a function of the level of lubricant in said scupper and of the position of the scupper relative to the second chamber.

3. A lubrication system as defined in claim 2, wherein excess flow from the filling and level maintaining circuit is fed to the engine components as the lubricant fluid spills over the scupper.

4. A lubrication system as defined in claim 2, wherein said scupper defines an orifice leading to said second chamber, and wherein a one-way valve is provided to prevent the lubricant contained in said second chamber from flowing into said scupper through said orifice.

5. A lubrication system as defined in claim 2, wherein said filling and level maintaining circuit includes a nozzle adapted to discharge a continuous flow of lubricant into said scupper.

6. A lubrication system as defined in claim 1, wherein said first and second chambers have a common vent.

7. A lubrication system as defined in claim 1, wherein said supply tank has a single lubricant level indicator for monitoring the level of lubricant in said first chamber, the level of lubricant in the second chamber being maintained substantially constant by the flow of lubricant passing through said filling and level maintaining circuit.

8. A lubrication system as defined in claim 2, wherein the lubricant withdrawn from the first chamber is passed through a filter before being directed into said second chamber.

9. A lubrication system for separately supplying lubricant to first and second set of components, comprising first and second lubricant circulating circuits for separately feeding lubricant to the first and second sets of components, said first and second lubricant circulating circuit being fed by a common supply tank having first and second separate chambers respectively connected in fluid flow communication with said first and second lubricant circulating circuits, a filler port defined in said supply tank for allowing said first chamber to be filled with lubricant, a pump for withdrawing lubricant from said first chamber, wherein a first portion of the lubricant pumped from said first chamber is directed to the first set of components via said first lubricant circulating circuit before being returned back to said first chamber, whereas a second portion of the lubricant fluid pumped from the first chamber is directed into said second chamber through a filling and level maintaining circuit connected to receive a flow of lubricant from said first chamber to initially permit filling of said second chamber and to subsequently maintain a predetermined volume of lubricant in said second chamber.

10. A lubrication system as defined in claim 9, wherein said filling and level maintaining circuit includes a scupper connected in fluid flow communication with said second chamber, said scupper forming a receptacle for receiving a continuous flow of lubricant from said first chamber, said scupper being in spill-over transfer relationship with the first set of components for allowing excess lubricant fed to said scupper to be re-circulated through said first lubricant circulating circuit.

11. A lubrication system as defined in claim 10, wherein said scupper defines a hole leading to said second chamber for allowing lubricant to flow from the scupper into the second chamber in order to automatically compensate for lubricant losses in the second lubricant circulating circuit.

12. A lubrication system as defined in claim 9, wherein said filling and level maintaining circuit includes a scupper forming a reservoir for automatically supplying lubricant to said second chamber in order to compensate for the lubricant consumption of the second set of components, while allowing excess lubricant flowing into said scupper to be redirected back into said first lubricant circulating circuit.

13. A lubrication system as defined in claim 12, wherein the scupper sets the level of lubricant in the second chamber.

14. A lubrication system as defined in claim 12, wherein said filling and level maintaining circuit includes a nozzle discharging a continuous flow of lubricant into said reservoir.

15. A lubrication system as defined in claim 9, wherein said first and second chambers have a common vent.

16. A lubrication system as defined in claim 9, wherein said supply tank has a single lubricant level indicator for monitoring the level of lubricant in said first chamber, the level of lubricant in the second chamber being maintained substantially constant by the flow of lubricant passing through said filling and level maintaining circuit.

17. A dual supply tank for independently supplying lubricant to a gas turbine engine lubricating circuit and an accessory lubricating circuit, comprising first and second separate chambers adapted to separately feed the gas turbine engine lubricating circuit and the accessory lubricating circuit, a single filler port for filling said first chamber, a nozzle for directing a flow of lubricant from said first chamber to a scupper, said scupper being connected in flow communication with said second chamber for allowing filling of said second chamber up to a predetermined level and thereafter redirect the excess lubricant flowing out of the nozzle away from said second chamber.

18. A tank as defined in claim 17, wherein said scupper forms a receptacle defining an orifice for allowing lubricant to flow from said scupper into said second chamber, wherein said receptacle is open for allowing excess lubricant supply to said scupper to spill-over from said receptacle.

19. A tank as defined in claim 17, wherein the scupper forms a reservoir for receiving a continuous flow of lubricant from said nozzle, said reservoir being configured for allowing spill-over of excess lubricant.

20. A tank as defined in claim 17, wherein said first and second chambers have a common vent.

* * * * *